United States Patent [19]

Scherer

[11] Patent Number: 5,007,759

[45] Date of Patent: Apr. 16, 1991

[54] ARRANGEMENT FOR ASSOCIATING AN ELECTRICAL DEVICE WITH A MOUNTING THEREFOR

[75] Inventor: Henry W. Scherer, Mt. Prospect, Ill.

[73] Assignee: S&C Electric Company, Chicago, Ill.

[21] Appl. No.: 267,584

[22] Filed: Nov. 7, 1988

[51] Int. Cl.[5] ..... B25G 3/00

[52] U.S. Cl. ..... 403/13; 403/24; 439/679

[58] Field of Search ..... 403/11, 13, 14, 24, 403/25; 439/679

[56] References Cited

U.S. PATENT DOCUMENTS

| | | | |
|---|---|---|---|
| 2,958,014 | 10/1960 | Blain | 317/101 |
| 3,229,242 | 1/1966 | Finney et al. | 339/184 |
| 4,379,610 | 4/1983 | Upchurch | 439/679 |
| 4,666,325 | 5/1987 | Vantouroux | 287/14 X |
| 4,687,277 | 8/1987 | Biller | 439/621 |
| 4,759,730 | 7/1988 | Sappington et al. | 439/622 |

FOREIGN PATENT DOCUMENTS

| | | | |
|---|---|---|---|
| 66257 | 6/1956 | France | 439/679 |
| 832658 | 4/1960 | United Kingdom . | |

OTHER PUBLICATIONS

S&C Descriptive Bulletin 252-14 30 dated Mar. 21, 1983 (28 pages).

*Primary Examiner*—Andrew V. Kundrat
*Attorney, Agent, or Firm*—James V. Lapacek

[57] ABSTRACT

An arrangement for associating an electrical device with a mounting is provided that includes cooperating structure to prevent the association of inappropriate electrical devices and mountings. Specifically, cooperating support structures that are provided on the mounting and carried by the electrical device cooperate to provide the supporting of the electrical device within the mounting; the cooperating support structures being dimensioned so as to interfere with and prevent the association and support of an electrical device in a mounting that is inappropriate therefor. In a specific arrangement, either the electrical device or the mounting carries receiving structure with defined openings, and the other of the electrical device or mounting carries interfitting protuberances. The appropriate dimensions of the protuberances and the openings prevent the association of inappropriate combinations of electrical devices and mountings while permitting the association of appropriate combinations of electrical devices and mountings. Each of the protuberances has different predetermined dimensions and the appropriate openings include corresponding dimensions. For example, in a specific configuration, a member or fitting attached to an electrical device includes a right-hand side protuberance that is larger than the left-hand side protuberance, and the appropriate mounting includes correspondingly disposed and dimensioned openings; i.e., the right-hand side opening being larger than the left-hand side opening. In this manner, different supports can be formed for two different electrical devices from identical stampings by bending of the stampings in opposite directions.

19 Claims, 1 Drawing Sheet

ARRANGEMENT FOR ASSOCIATING AN ELECTRICAL DEVICE WITH A MOUNTING THEREFOR

BACKGROUND OF THE INVENTION

1. Field of the Invention

The present invention relates generally to an arrangement and method for associating an electrical device with a mounting therefor, and more particularly to a component of an electrical device mounting that is provided with an arrangement to prevent the insertion of an electrical device into a mounting that is not appropriate for the particular electrical device.

2. Description of the Related Art

Various arrangements have been proposed for associating and/or connecting circuit interrupters such as fuses. Additionally, arrangements have also been proposed for other fields involving electrical devices such as multi-pin connectors, circuit boards or cards, etc. For example, such arrangements are disclosed in U.S. Pat. Nos. 2,958,014, 3,229,242, 4,687,277, and 4,759,730 and British Patent Publication 832,658. The British publication 832,658 provides plug connectors on respective components which include interfitting teeth and notches in the respective plug connectors. U.S. Pat. No. 2,958,014 provides a combination of notches in insertable circuit boards and teeth projecting from a mounting rack such that only the correct circuit board can be moved into a particular position or slot. In this manner, movement of the circuit card (so as to supply power to the card via appropriate connectors) is prevented if the card is in the wrong slot. U.S. Pat. No. 3,229,242 utilizes a connector with contact pins of two different sizes so as to ensure appropriate connection with respective-sized socket members. U.S. Pat. No. 4,759,730 is directed to a polarized fuse holder assembly wherein a boss is formed on one member (2-pole line-side housing) and a notch is formed on a second interfitting member (2-pole load-side housing) to ensure proper assembly of the members. Additionally, a groove is also formed in a housing or other receptacle so as to be aligned with the boss so as to polarize the two assembled members and the receptacle. U.S. Pat. No. 4,687,277 provides an improved connection arrangement that is affixed to the electrical connection member of an electrical device; the connector arrangement also including facilities for interconnection to a mounting for the electrical device. The improved connector arrangement includes clamping elements that are arranged so that they can be affixed only to appropriate electrical connection members of the electrical device. Additionally, the arrangement also includes an extending member carried by one of the connection arrangements and a cooperating member carried by the mounting such that inappropriate combinations of extending members and cooperating members on the mounting interfere to prevent the insertion of an electrical device into an inappropriate mounting.

While these arrangements may be generally suitable for their intended purposes, it is desirable to provide efficient arrangements to avoid the inappropriate insertion of electrical devices into mountings that are not appropriate for the electrical device. For example, it is desirable to provide a simplified arrangement to prevent the inappropriate insertion of an electrical device into a mounting where no additional parts are required other than the cooperating support structure of the electrical device and the mounting.

SUMMARY OF THE INVENTION

Accordingly, it is a principal object of the present invention to provide an efficient arrangement for associating an electrical device with an appropriate corresponding mounting while preventing the association of the electrical device with inappropriate mountings.

It is another object of the present invention to provide a component of an electrical device mounting that cooperates with an electrical device for supporting the electrical device in a mounting and for preventing the association of the electrical device into inappropriate mountings.

It is a further object of the present invention to provide a method to prevent the insertion of an electrical device of a first type having an attached fitting of a first type into an inappropriate mounting that includes support structure for cooperating with an appropriate fitting of a second type by providing the combination of different-dimensioned electrical-device-fitting support structure for different types of electrical devices and appropriately dimensioned cooperating support structures on the mounting that interfits only with the appropriate corresponding support structure of the electrical device fitting.

It is a yet another object of the present invention to provide an electrical device and a mounting therefor which include cooperating structure to provide a support hinge; the interfitting portions that perform the hinge function being dimensioned so as to prevent the association of inappropriate electrical devices and mountings.

Briefly, these and other objects and advantages of the present invention are efficiently achieved by providing an arrangement for associating an electrical device with a mounting therefor. The arrangement includes cooperating structure to prevent the association of inappropriate electrical devices and mountings. Specifically, cooperating support structures that are provided on the mounting and carried by the electrical device cooperate to provide the supporting of the electrical device within the mounting; the cooperating support structures being dimensioned so as to interfere with and prevent the association and support of an electrical device in a mounting that is inappropriate therefor. In a specific arrangement, the cooperating support structures of the mounting and the electrical device provide a support hinge. Either the electrical device or the mounting carries receiving structure with defined hinge openings, and the other of the electrical device or mounting carries interfitting protuberances or trunnion bosses. The appropriate dimensions of the trunnion bosses and the hinge openings prevent the association of inappropriate combinations of electrical devices and mountings while permitting the association of appropriate combinations of electrical devices and mountings. In a preferred configuration of the specific arrangement, each of the trunnion bosses has different predetermined dimensions and the appropriate hinge openings include corresponding dimensions. For example, in a specific configuration, a member or fitting attached to an electrical device includes a right-hand side trunnion boss that is larger than the left-hand side trunnion boss, and the appropriate mounting includes correspondingly disposed and dimensioned hinge openings; i.e., the right-hand side hinge opening being larger than the left-hand side hinge opening. In this manner, a support or bracket carrying the hinge openings can be formed from a hinge stamping for one particular mounting by the bending thereof to define right- and left-hand sides with the right-hand side hinge opening being larger than the left-hand side. Further, a support or bracket carrying the hinge openings can be formed from the same hinge stamping by the bending of the stamping in the opposite direction so as to provide the larger hinge opening on the left-hand side and the smaller hinge opening on the right-hand side; i.e., different support hinges can be formed for two different electrical devices from the identical stamping by bending of the stamping in opposite directions.

BRIEF DESCRIPTION OF THE DRAWING

The invention, both as to its organization and method of operation, together with further objects and advantages thereof, will best be understood by reference to the following specification taken in conjunction with the accompanying drawing in which like reference numerals refer to like elements and in which.

DETAILED DESCRIPTION

The present inventIon relates to electrical devices and mountings therefor and particularly to medium- and high-voltage electrical interrupting devices such as fuses and appropriate mountings, as disclosed for example in U.S. Pat. Nos. 4,268,811, 4,422,062, 4,667,277, 4,158,830, and Design Patent No. 254,668. Reference may be made to these patents for a more detailed discussion of electrical devices and mountings therefor, as well as the manner in which the electrical devices are manipulated within the mountings and utilized, these patents being incorporated herein by reference for all purposes.

Figure 1:
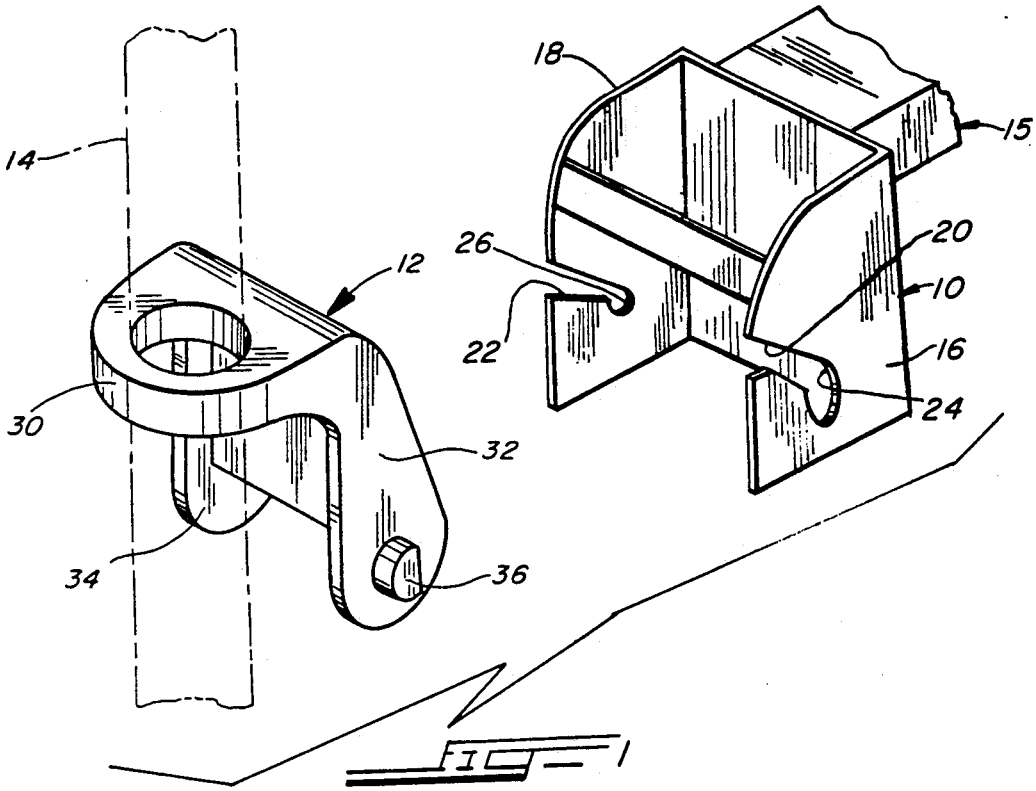
FIG. 1 is a perspective view of a support bracket of an electrical device mounting and a cooperating member or fitting carried by an electrical device in accordance with the present invention.

Referring now to FIG. 1, the arrangement of the present invention will be specifically described in terms of the illustrated support 10, a component of an electrical device mounting referred to generally at 15, and the member or fitting 12 which is carried by or with an electrical device generally referred to at 14. The support 10 may also be referred to as a bracket or hinge. The member or fitting 12 will hereafter be referred to as the fitting 12. While the invention will be described in terms of the specific arrangement illustrated in FIG. 1, it should be realized that the present invention is useful with various other electrical device arrangements and mountings therefor. In the particular arrangement illustrated in FIG. 1, the support 10 of the mounting 15 and the fitting 12 of the electrical device 14 include cooperating support structures for associating the electrical device 14 with the support 10 of the mounting. The support 10 includes spaced-apart support plates 16,18.

Figure 2:
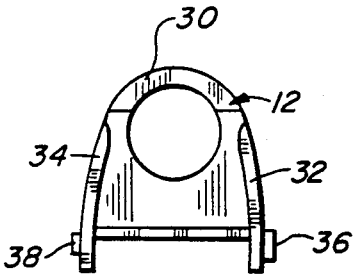
FIG. 2 is a bottom plan view of the member or fitting of FIG. 1 carried by the electrical device.

In accordance with important aspects of the present invention, the cooperating support structures of the support 10 and the fitting 12 that support the electrical device 14 within the support 10 are arranged to prevent the association of electrical devices 14 and supports 10 which are inappropriate and do not correspond to the appropriate combination. For example, in the particular configuration of FIG. 1, the support 10 is provided with slots 20,22 which lead into predetermined respectively defined hinge openings 24,26. The hinge opening 24 is defined with predetermined dimensions so as to be a predetermined amount larger than the hinge opening 26. Similarly, the slot 20 is defined with a predetermined width that is a predetermined amount larger than the slot 22. The fitting 12 includes a portion 30 for the attachment to and interfitting with the electrical device 14. Referring also now to FIG. 2, the fitting 12 also includes elongated, spaced-apart legs 32,34. The spaced-apart portions or legs 32,34 include protuberances or trunnion bosses 36,38 respectively, which will be referred to hereafter as trunnion bosses. The trunnion bosses 36,38 are suitably dimensioned along with the spacing of the legs 32,34 for interfitting with the respective hinge openings 24,26 such that the electrical device 14 with attached fitting 12 is associated with and supported by the support 10. Thus, in FIG. 1, the right-hand side trunnion boss 36 is larger than the left-hand side trunnion boss 38.

Accordingly, in accordance with the present invention, the right-hand side trunnion boss 36 does not fit into the left-hand side hinge opening 26, such that a fitting 12 with a trunnion boss on the left-hand side dimensioned as the trunnion boss 36 could not be associated with the support 10. Similarly, if the support 10 is fabricated with the larger opening 24 on the left-hand side support plate 18, the fitting 12 with the large trunnion boss 36 on the right-hand side cannot be associated with the support 10. Thus, fittings 12 with attached electrical devices 14 that are not appropriate for the support 10 are prevented from being associated therewith. It should be noted that if the supports 10 and fittings 12 were fabricated with both hinge openings 24,26 and both trunnion bosses 36,38 being of the larger or smaller size, then the fitting 12 with the smaller trunnion boss would be capable of association with a support 10 having the larger hinge openings, which would be undesirable.

Figure 3:
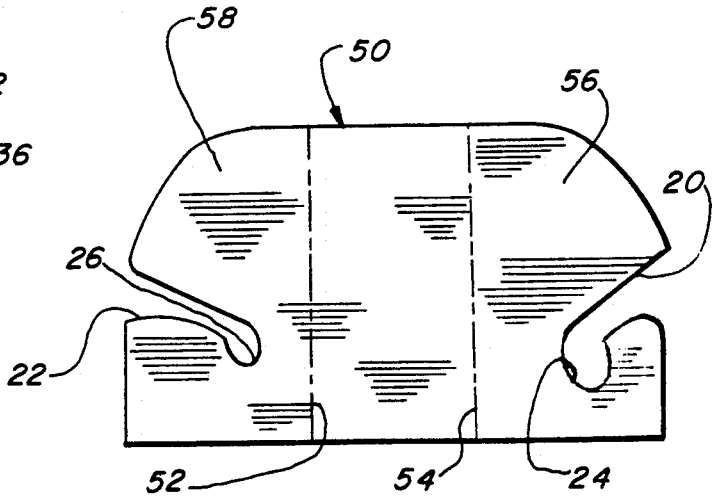
FIG. 3 is an illustration of a stamping for fabrication of the support bracket of FIG. 1.

Referring now to FIG. 3, a flat stamping 50 is illustrated from which the support 10 may be fabricated. For example, by appropriate bends at 52,54 upward out of the plane of FIG. 3, the support 10 may be formed such that the portion 56 would form the right-hand support plate 16 with the defined hinge opening 24 and the portion 58 would form the support plate 18 with the defined hinge opening 26. However, if the stamping 50 is manipulated such that the bends at 52 and 54 are made downward in the plane of FIG. 3, then the portion 58 forms the right-hand support plate 16 and the portion 56 forms the left-hand support plate 18. In that case, the larger hinge opening 24 would be provided at the left-hand side of the support 10 and the smaller hinge opening 26 would be provided at the right-hand side thereof.

While there have been illustrated and described various embodiments of the present invention, it will be apparent that various changes and modifications will occur to those skilled in the art. For example, while the present invention has been described by an illustrative embodiment with two different types of electrical devices and mountings, it should be realized that the present invention in other specific embodiments provides three or more different electrical devices and mountings with predetermined distinct dimensions. For example, each fitting 12 includes two trunnion bosses 36,38 which have different dimensions from each other and from the trunnion bosses of all other types of electrical devices. Specifically, the paired dimensions of the trunnion bosses 36,38 for three different fittings 12 of three respective different electrical devices could be D1,DA; D2,DB; D3,DC, etc., where DC>DB>DA>D1>D2>D3. Additionally, each combination could be reversed, left to right, to double the number of combinations. Further, other facilities can be utilized to provide a method to prevent the insertion of one type of electrical device with a first attached fitting into a mounting including support structure that is arranged to cooperate with a second type of electrical device and a second attached fitting; the method including the provision of different-dimensioned electrical-device-fitting support structure for different types of electrical devices and appropriately dimensioned cooperating support structure on the mounting that interfits only with the appropriate corresponding support structure of the electrical device fitting. It is intended in the appended claims to cover all such changes and modifications as fall within the true spirit and scope of the present invention.

What is claimed and desired to be secured by Letters Patent of the United States is:

1. A system for preventing different types of electrical devices from being associated with inappropriate mountings, the electrical device including a fitting, the mounting including a support arrangement, the fitting and the support arrangement including cooperating support structure to support the electrical device with respect to the support arrangement, said cooperating support structure including predetermined different dimensions for each different type of electrical device and corresponding support arrangement such that each type of electrical device can be associated only with the corresponding support arrangement and preventing other combinations of support arrangements and electrical devices of different types from being associated, said cooperating structure comprising two spaced-apart protuberances on a first of said fitting or support arrangement and two spaced-apart receiving arrangements on the other of said fitting or support arrangement, said two protuberances each having a cross section of different predetermined dimension, said receiving arrangements each being dimensioned to interfit with and receive a respective one of said two protuberances, a first type of electrical device and corresponding first support structure and a second type of electrical device and corresponding second support structure including protuberances and receiving arrangements of the same predetermined dimensions but being reversed left to right from said first type to said second type.

2. The system of claim 1 wherein said two receiving arrangements are dimensioned such that one of said two protuberances can only be received within one of said two receiving arrangements.

3. The system of claim 1 wherein said support arrangement includes said two receiving arrangements and wherein said fitting includes said two protuberances, said two receiving arrangements having openings of different predetermined dimensions.

4. The system of claim 3 wherein said support arrangement includes two spaced-apart support members, each of said openings being defined in a respective one of said support members.

5. The system of claim 4 wherein said support arrangement further includes a back wall spanning said two support members.

6. A method to prevent the insertion of an electrical device of a first type into an inappropriate mounting of a second type, the electrical device and the mounting including cooperating support structures for supporting the electrical device with respect to the mounting, the method comprising the provision of different dimensioned cooperating support structure for different types of electrical devices and the corresponding appropriate mountings including a first combination of cooperating support structure having first predetermined dimensioned structure corresponding to a first type of electrical device and a first type of mounting, and a second combination of cooperating support structure having second predetermined dimensioned structure corresponding to a second type of electrical device and a second type of mounting, whereby said first type of electrical device is not capable of association with said second type of mounting and said second type of electrical device is not capable of association with said first type of mounting, said cooperating support structure for the electrical device defining two spaced-apart portions of different predetermined dimensions and the corresponding mounting defining two cooperating spaced-apart portions of corresponding predetermined dimensions, said cooperating support structures comprising said mounting including a support, said support including two openings of different predetermined dimensions, said cooperating support structure further comprising said electrical device including two spaced-apart protuberances of different predetermined dimensions, said support being and the electrical device include cooperating support structure, first and second types of mountings, said cooperating support structure comprising first means carried by said mounting, said first means of said first and second types of mountings each having different predetermined dimensions such that a first type of electrical device is not capable of association with said second type of mounting and such that a second type of electrical device is not capable of association with said first type of mounting, said first and second types of mountings include two side walls that are spaced apart and generally planar, said first means being carried by said two side walls, said first means comprising second and third means each having different predetermined dimensions and each being carried by a respective one of said two side walls, each of said second and third means defining said different predetermined dimensions in a respective plane that is generally parallel to a respective one of said two side walls.

7. The method of claim 6 wherein a first type of support is provided by bending portions of said planar member in a first manner and a second type of support is provided by bending portions of said planar member in a second manner.

8. The method of claim 6 wherein said first type of support is provided by forming said two spaced-apart side walls by two bending operations in a first direction out of the plane of said planar member, and said second type of support is provided by two bending operations in a second direction opposite to said first direction and out of the plane of said planar member.

9. A method for providing two different hinge components for use with an electrical equipment mounting, each of the two hinge components including two spaced-apart side walls, a back wall spanning said two spaced-apart side walls, and each of said two spaced-apart side walls including a hinge opening of different predetermined dimensions, the method comprising stamping a planar member from a sheet of material so as to define said two hinge openings, and thereafter either bending said planar member at two predetermined locations in a first direction out of the plane of said planar member to provide a first hinge, or bending said planar member at said two predetermined locations in a second direction opposite to said first direction and out of the plane of said planar member to provide a second hinge.

10. A support arrangement for an electrical device, the support arrangement including a first support means and a second support means carried with the electrical device, the support arrangement further including cooperating means on said first support means and said second support means for structurally cooperating to support the electrical device with respect to the first support means, a first of said first or second support means including two protuberances that are spaced apart in a first direction, and the second of said first or second support means including two spaced-apart receiving arrangements adapted to receive said two protuberances, wherein the improvement comprises said two protuberances being of different predetermined sizes, each of said different predetermined sizes being defined in a respective plane that is generally perpendicular to said first direction such that the larger of the two protuberances interferes with and cannot be inserted into one of said two receiving arrangements.

11. A support arrangement for an electrical device including a support hinge including two spaced-apart side walls and a first member carried with the electrical device including two protuberances that are spaced apart in a first direction, each of said two spaced-apart side walls defining an opening of a different predetermined dimension, each of said two protuberances having different predetermined dimensions which are adapted to interfit with a respective one of said openings, each of said different predetermined dimensions of said two protuberances being defined in a respective plane that is generally perpendicular to said first direction.

12. In a system for preventing different types of electrical devices from being associated with inappropriate mountings wherein the mount-fabricated from a planar member so as to provide two spaced-apart planar side walls and a back wall spanning said two spaced-apart side walls, each of said openings being defined in a respective one of said two spaced-apart side walls.

13. A system for preventing different types of electrical devices from being associated with inappropriate mountings, the mounting including a support arrangement, the electrical device and the support arrangement including cooperating support structure to support the electrical device with respect to the support arrangement, said cooperating support structure including predetermined different dimensions for each different type of electrical device and corresponding support arrangement such that each type of electrical device can be associated only with the corresponding support arrangement and preventing other combinations of support arrangements and electrical devices of different types from being associated, said cooperating structure comprising first and second spaced-apart protuberances on a first of said electrical device or support arrangement and first and second spaced-apart receiving arrangements on the other of said electrical device or support arrangement, said first and second protuberances each having a different predetermined dimension, said first and second receiving arrangements each being dimensioned to interfit with and receive a respective one of said first and second protuberances, the first protuberance for a first type of electrical device having a larger predetermined dimension than that of a first protuberance for a second type of electrical device, the second protuberance for said first type of electrical device having a smaller predetermined dimension than that of the second protuberance for said second type of electrical device.

14. The system of claim 13 wherein the predetermined dimension of said first protuberance of said first type of electrical device and said second protuberance of said second type of electrical device are equal.

15. The system of claim 14 wherein the predetermined dimension of said second protuberance of said first type of electrical device and said first protuberance of said second type of electrical device are equal.

16. The system of claim 13 wherein, for said first type of electrical device the predetermined dimension of said first protuberance is larger than the predetermined dimension of said second protuberance.

17. A system for preventing different types of electrical devices from being associated with inappropriate mountings, the electrical device and the mounting comprising means for defining cooperating support structure to support the electrical device with respect to the mounting, said cooperating support structure comprising first and second means for defining respective first and second combinations of interfitting and cooperating protuberances and receiving arrangements, said first and second means having different predetermined dimensions by virtue of said first and second combination of interfitting and cooperating protuberances and receiving arrangements each having different predetermined dimensions, said first means for a first type of electrical device and corresponding first type of mounting having larger predetermined dimensions than that of said first means for a second type of electrical device and corresponding second type of mounting, said second means for said first type of electrical device and corresponding first type of mounting having smaller predetermined dimensions than that of said second type of electrical device and corresponding second type of mounting.

18. The system of claim 17 wherein, for said first type of electrical device said predetermined dimensions of said first means are greater than said predetermined dimensions of said second means.

19. An arrangement for an electrical device including two spaced apart side walls that are generally planar and generally parallel to each other, the support arrangement further including a receiving arrangement defined in each of said two spaced apart side walls, each of said two spaced apart receiving arrangements being of a different predetermined size, said different predetermined size of each receiving arrangement being defined in the plane of said respective generally planar side wall.

* * * * *

UNITED STATES PATENT AND TRADEMARK OFFICE

CERTIFICATE OF CORRECTION

PATENT NO. : 5,007,759

DATED : April 16, 1991

INVENTOR(S) : Henry W. Scherer

It is certified that error appears in the above-identified patent and that said Letters Patent is hereby corrected as shown below:

Claim 6, lines 31-50 (column 6, line 31-50): delete the remainder of line 31 after "being" and delete lines 32-50, substitute the following -- fabricated from a planar member so as to provide two spaced-apart planar side walls and a back wall spanning said two spaced-apart side walls, each of said openings being defined in a respective one of said two spaced-apart side walls. --

UNITED STATES PATENT AND TRADEMARK OFFICE

CERTIFICATE OF CORRECTION

PATENT NO. : 5,007,759

DATED : April 16, 1991

INVENTOR(S) : Henry W. Scherer

It is certified that error appears in the above-identified patent and that said Letters Patent is hereby corrected as shown below:

Claim 12, lines 3-7 (column 7, lines 44-48), delete the remainder of line 44 after "the" and delete lines 45-48, substitute therefor the following -- mounting and the electrical device include cooperating support structure, first and second types of mountings, said cooperating support structure comprising first means carried by said mounting, said first means of said first and second types of mountings each having different predetermined dimensions such that a first type of electrical device is not capable of association with said second type of mounting and such that a second type of electrical device is not capable of association with said first type of mounting, said first and second types of mountings include two side walls that are spaced apart and generally planar, said first means being carried by said two side walls, said first means comprising second and third means each having different predetermined dimensions and each being carried by a respective one of said two side walls, each of said second and third means defining said different predetermined dimensions in a respective plane that is generally parallel to a respective one of said two side walls. --

Signed and Sealed this

Fifteenth Day of September, 1992

*Attest:*

DOUGLAS B. COMER

*Attesting Officer*

*Acting Commissioner of Patents and Trademarks*